US005610702A

United States Patent [19]

Snelling

[11] Patent Number: 5,610,702

[45] Date of Patent: Mar. 11, 1997

[54] COLOR XEROPRINTING MASTER AND PROCESS

[75] Inventor: Christopher Snelling, Penfield, N.Y.

[73] Assignee: Xerox Corporation, Stamford, Conn.

[21] Appl. No.: 585,229

[22] Filed: Jan. 11, 1996

[51] Int. Cl.[6] ..... G03G 15/01

[52] U.S. Cl. ..... 399/298; 430/42; 347/115

[58] Field of Search ..... 355/326 R, 327, 355/210, 200; 430/42, 41; 347/115, 172

[56] References Cited

U.S. PATENT DOCUMENTS 3,888,664 6/1975 Carlson et al. .
3,999,481 12/1976 Sankus ..... 101/451
4,149,798 4/1979 McGowin et al. .
4,358,195 11/1982 Kuehnle et al. .
5,405,723 4/1995 Rhodes et al. ..... 355/327 X
5,464,716 11/1995 Yashiki ..... 430/41

*Primary Examiner*—R. L. Moses
*Attorney, Agent, or Firm*—Lloyd F. Bean, II

[57] ABSTRACT

An apparatus for producing a color image on a sheet member including an electrographic master having a representative of at least two color components of the color image. A transfer system is provided for transferring at least two color components of the color image from the electrographic master to a sheet member. A development system is provided for sequentially developing said at least two color components of the color image in a predetermined alignment on the electrographic master.

12 Claims, 4 Drawing Sheets

COLOR XEROPRINTING MASTER AND PROCESS

COPENDING APPLICATION

U.S. Ser. No. 08/585,034, entitled "COLOR XEROPRINTING MASTER" file concurrently herewith is hereby incorporated by reference.

BACKGROUND OF THE INVENTION

The invention relates generally to a printing system, and more particularly concerns an apparatus capable of producing reprographic masters and for subsequent printing on copy sheets by employing previously produced masters in printing operations.

To date, the entry of electronic high quality, monochrome and multicolor reprographic printing systems into the commercial printing market has been limited by factors relating to the quality of the image produced by these systems, the productivity of these systems and by the development and capital unit costs associated with this technology.

The commercial printing market has recently increasingly utilized computer technology, particularly in the field of color printing. However, this utilization has generally been limited to preparatory operations, such as text editing, composition, page make-up, plate or master making, and associated functions. The standard commercial printing processes themselves, principally letterpress offset lithography and gravure, are not readily computer compatible. Even the most advanced printing operations now available utilize computerized processes, based on digital technology, only up to the preparation of the film, or in some instances up to the preparation of the printing plates, masters, or cylinders. Beyond this stage in the process, these media are then used with traditional techniques and equipment to produce printed sheets. This is, at least in part, due to the fact that computer compatible printing processes, such as electrophotography, ink-jet and thermography, cannot yet satisfy the normal image quality and productivity requirements of most segments of the commercial multicolor printing market. Thus, there is a need for an automated system capable of printing high quality images, at a sufficient rate, from information received either directly from a computer or scanned from existing images.

Recent developments have vastly improved the quality of the images produced by electronic reprographic systems. However, currently available systems have been unable to meet the productivity and reliability requirements of the commercial printing market. There is thus a need for a printing apparatus for rapidly and reliably producing multiple copies of high image quality.

SUMMARY OF THE INVENTION

In accordance with the invention there is provided an apparatus and method for producing a color image on a sheet member including an electrographic master having representative of at least two color components of the color image; and a transfer system for transferring at least two color components of the color image from the electrographic master to a sheet member. The transfer system includes a development system for sequentially developing said at least two color components of the color image in a predetermined alignment on the electrographic master.

These and other aspects of the invention will become apparent from the following description used to illustrate a preferred embodiment of the invention read in conjunction with the accompanying drawings.

DESCRIPTION OF THE PREFERRED EMBODIMENT

Figure 1:
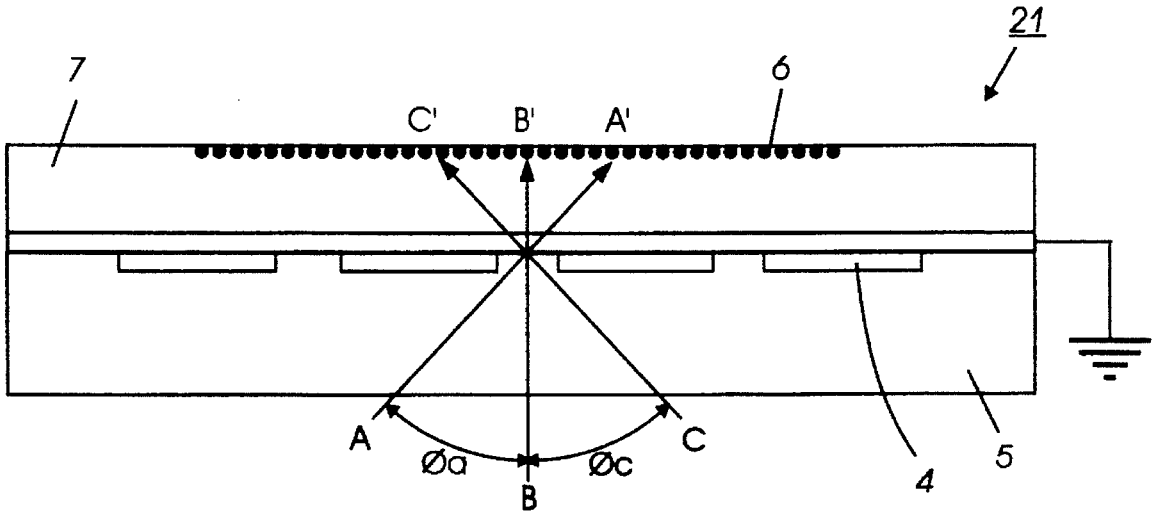
FIG. 1 shows an embodiment of a master structure according to the present invention.

For a general understanding of the features of the present invention, reference is made to the drawings. In the drawings, like references have been used throughout to designate identical elements. It will become apparent that the present invention is equally well suited for use in a wide variety of printing systems and is not necessarily limited to those systems shown herein.

Figure 2:
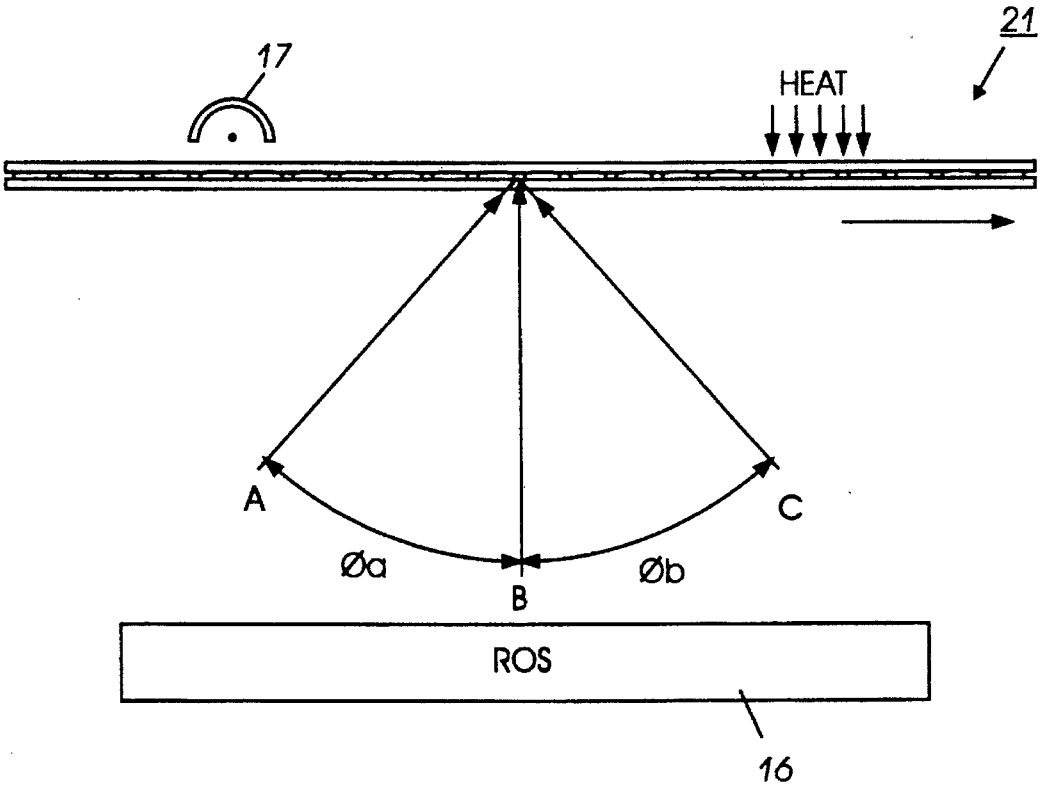
FIG. 2 shows a process schematic of a master making unit of a printing apparatus according to the present invention.
Figure 3:
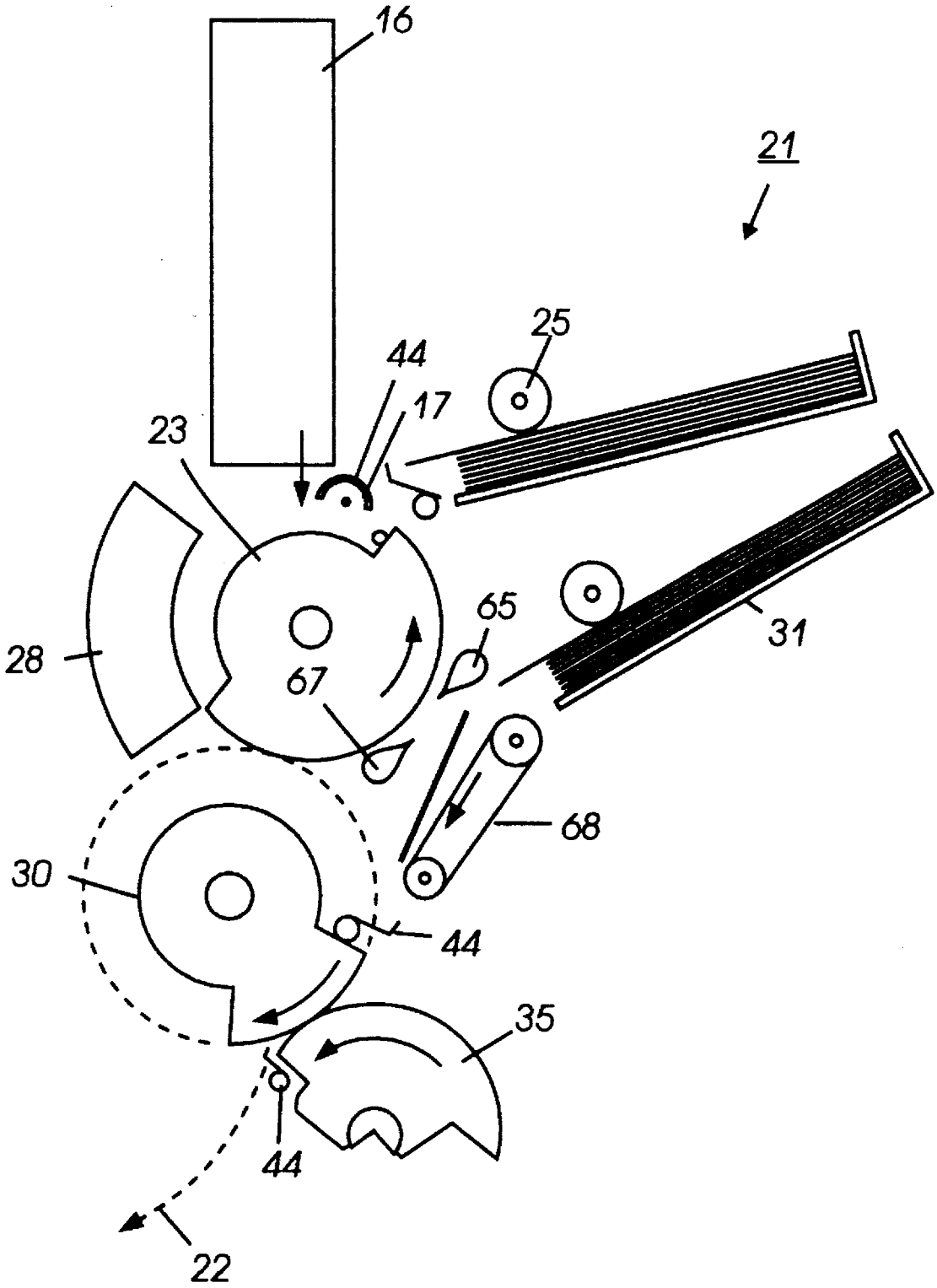
FIG. 3 shows a master making unit of a printing apparatus according to the present invention.

Turning initially to FIGS. 2 and 3, a reprographic printing apparatus according to the present invention, is a master making unit 2, and a printing unit 3 having three developers. Since three developers are commonly used for commercial color printing, these illustrations and this description are based on the use of such three developers. It will be understood, however, that the number of such developers may be 1, 2, 3, or numbers larger than 3. These units are referred to as color units but it will be understood that the term color also applies if the developers produces a black image, as is normally true for one of the units of such printing apparatus.

During operation of the printing system, an image data stream representing an image is fed by electronic means to the master making unit 2, as is well known in the art. An example of such feeding of an image data stream is the stream fed from a computer work station by cable to a laser printer such as the Hewlett-Packard Laserjet IIP. Unexposed photoreposive masters are fed, one at a time, from a feeder tray 21, to master making cylinder 23, via feed mechanism, 25 as is well known in the art. The master is held in position on the master making cylinder 23 by means of known gripper mechanisms 44. An example of such means for feeding and gripper holding of such masters is the Total Copy System, sometimes referred to as Copymaker, manufactured by the Addressograph Multigraph Company of Mt. Prospect, Ill.

A Raster Output Scanner (ROS) 16, which may include a laser and an associated rotating polygon mirror assembly as is known in the art, transfers the digital image data stream to the master in the form of small pixels arrayed in a series of horizontal scan lines with each line having a specified number of pixels per inch. It will be understood that optical imaging devices other than a laser scanner can also be used to expose the master for forming an pattern image. Such other devices may include the general category of what is generally known in the industry as image bars. As the master making cylinder 23 is continuously rotated counterclockwise at a speed which is compatible with the process requirements of master making, successive line elements of a master held on the master making cylinder 23 are rotated counterclockwise past the ROS 16. Charging device 17 charges the total surface of the master and then selectively exposes the master in accordance with the image data.

An example of such a process and of the master material is disclosed in the Journal of Imaging Science, Vol. 32, No. 6, 1988, pp. 247–254, describing the use of a master called Xerox AMEN (Agglomeration Migration Electrophotographic Negative). Conventional monochrome AMEN and HEP Xeroprinting operates with the following sequence of process steps: uniformly charge master, uniformly expose master to light, develop toner image, transfer to paper, fuse, clean master, etc. In the present invention the uniform master exposure process step is replaced with incremental exposures of master areas corresponding to areas onto which pre-determined (in the master creation process) toner color development is desired.

The technique proposed to enable the required incremental master exposure steps delineating areas for specific toner color developments is to include within the master optical masking means for appropriate external illumination source(s). Refer to FIG. 1 the structure is similar to the monochrome master structure represented except for the addition of an opaque line screen 4 at the surface of the transparent polyester base 5. The purpose of the line screen is to provide a shadow mask limiting illumination of photosensitive particles 6 at areas A', B' and C' of the master top surface to light from sources A, B, and C at appropriate angles *Øa, Øb, Øc* respectively. A line screen configuration having the exposure "slits", orthogonal to the xeroprinting process direction is provided. Peferrably, the line screen pattern has between 150 to 300 lines/inch. The function of the shadow mask is to enable selective illumination, and therefore selective discharge, of areas of the master onto which specific color toner development is desired. The necessary criteria for toner development also includes the presence of photosensitive particles in the softenable thermoplastic charge transport layer 7 to act as charge generators in the incremental exposure process step. Presence, or absence, of photosensitive particles at the master surface would be pre-determined in multiple Discharge Area Development (DAD'n). An example of such a process is disclosed in U.S. Pat. No. 4,403,848 which is hereby incorporated by reference.

As shown in FIGS. 2 and 3, ROS exposures to create the masters are made at the same angles (*Øa*, and *Øb*) used later to incrementally discharge the master for discharge area development. In the master creation process, however, all three ROS exposures are made simultaneously. It is because of the simultaneous ROS exposure process used to create the master for this proposed DAD'n Xeroprinting process that subsequent Xeropress design and operation can be considerably simplified. Motion quality requirements, for example, are relaxed since the color determining information is simultaneously encoded into the master essentially perfect registration. Registration errors will be limited to those due to ROS design faults. A multiple beam output image bar apparatus may be more appropriate than a ROS exposure apparatus for the master creation process. With an image bar, the optical information input could be "clocked" synchronous with motion of the master film during the creation step. Motion detection could be based upon the opaque (reflective) line screen pattern already included within the master film structure. With at least two motion detectors, skew information could also be detected to enhance the master creation exposure process.

Referring to FIG. 2, a simple heat step is employed in this processing step following exposure to create the master. Heat processing alone (HEP) is attractive because of it's simplicity. AMEN processing, in which organic vapors are used followed by heat, is also an option.

Referring back to FIG. 3, immediately following charge and exposure, master making cylinder 23 is further rotated counter-clockwise bringing each master adjacent a master processor 28. The masters are processed in the master processor 28 so as to produce a permanent latent image on the master which, because of its electrical resistivity, can hold a charge for subsequent development, while non-image areas are rendered permanently conductive so that they cannot hold such a charge. The image on the exposed master corresponds to the particular color component of the original. The master, therefore, forms a set of subtractive primary latent images which are suitable for printing in a multicolor process to be described in the following.

During further counter-clockwise rotation of the master making cylinder 23, the master is ejected sequentially by known means, face down, onto master stand-by tray 31. Specifically, a stripper element 65 assures that each master is stripped from the master making cylinder 23 after rotation past the/ROS 16 and the master processor 28 and the masters are, subsequently, deposited into the master stand-by tray 31.

Master making cylinder 23 is driven by an electric servomotor (not shown), which is independent of the operation of the power sources which drive the other elements of the printing apparatus. Specifically, the rotation of the master making cylinder 23 is at a speed of rotation appropriate for the master material. For the AMEN master material referenced earlier, this speed provides a linear velocity of the master of, for example, 6 inches per second.

Recorded on the master leaving the master making cylinder 23, are three latent images. For example, in a typical three color printing apparatus, each latent image, which corresponds to a particular color component of the image, is selected for development with cyan developer material. Another latent image is selected for development with magenta developer material and a third latent image is selected for development with yellow developer material. These latent images formed by ROS 16 on the masters correspond to the image signals received by the master making unit 2.

When a print run of copy sheets, using the masters in master stand-by tray 31, is ready to begin, i.e. either immediately after creation of the masters or after completion of the previous print run, to be described in the following, whichever occurs last, each of the next masters is fed into the sheet path via reciprocating transfer 33 and impression cylinder 35, in the direction of arrow 22. It should be understood that the term impression cylinder as directed to impression cylinder 35 of the master making unit is descriptive only of the structure of the cylinder and is not meant to suggest that printing takes place in the master making unit. Masters are fed out of the stand-by tray 31 via feed rollers 66, under guide element 67 and over belt transfer 68 onto reciprocating transfer 33. The reciprocating transfer 33 includes gripper mechanisms 44 which take the masters which are fed sequentially out of the stand-by tray 31 and which hold each master for conveyance by the reciprocating transfer 33 into contacting gripper mechanisms on the impression cylinder 35. The reciprocating transfer 33 then rotates clockwise past the location at which the gripper mechanisms of the reciprocating transfer 33 and the impression cylinder 35 interact, to a rest position where it does not interfere further with the movement of the master. As the impression cylinder, and the master gripped thereon, rotates counterclockwise, it draws each master sequentially into the sheet path and the master is conveyed to the appropriate printing unit 4. After the trailing edge of each master has moved onto the impression cylinder 35, the reciprocating transfer 33 returns to its extreme counterclockwise position to receive the subsequent master.

Power is transmitted from electric servo-motor directly to the master making cylinder 23. Those skilled in the art will recognize that, through standard control of the gripper mechanisms 44 on master making cylinder 23, reciprocating transfer 33, and impression cylinder 35, each of these components may rotate freely past one another with no contact or interference between the sheet members being transported by the components.

Once in the sheet path, master is directed to a printing unit 3 through the sheet path in the direction of arrow 22 by means of known sheet feeding mechanisms. Each master is then transmitted to the impression cylinder 35 in printing unit 3 and is automatically clamped onto that cylinder by gripper means well known in the art. Impression cylinder 35 is a transparent drum support for the master film structure. The drum configuration has the advantage of being self-tracking. It should be evident that a belt configuration can be employed.

Figure 4:
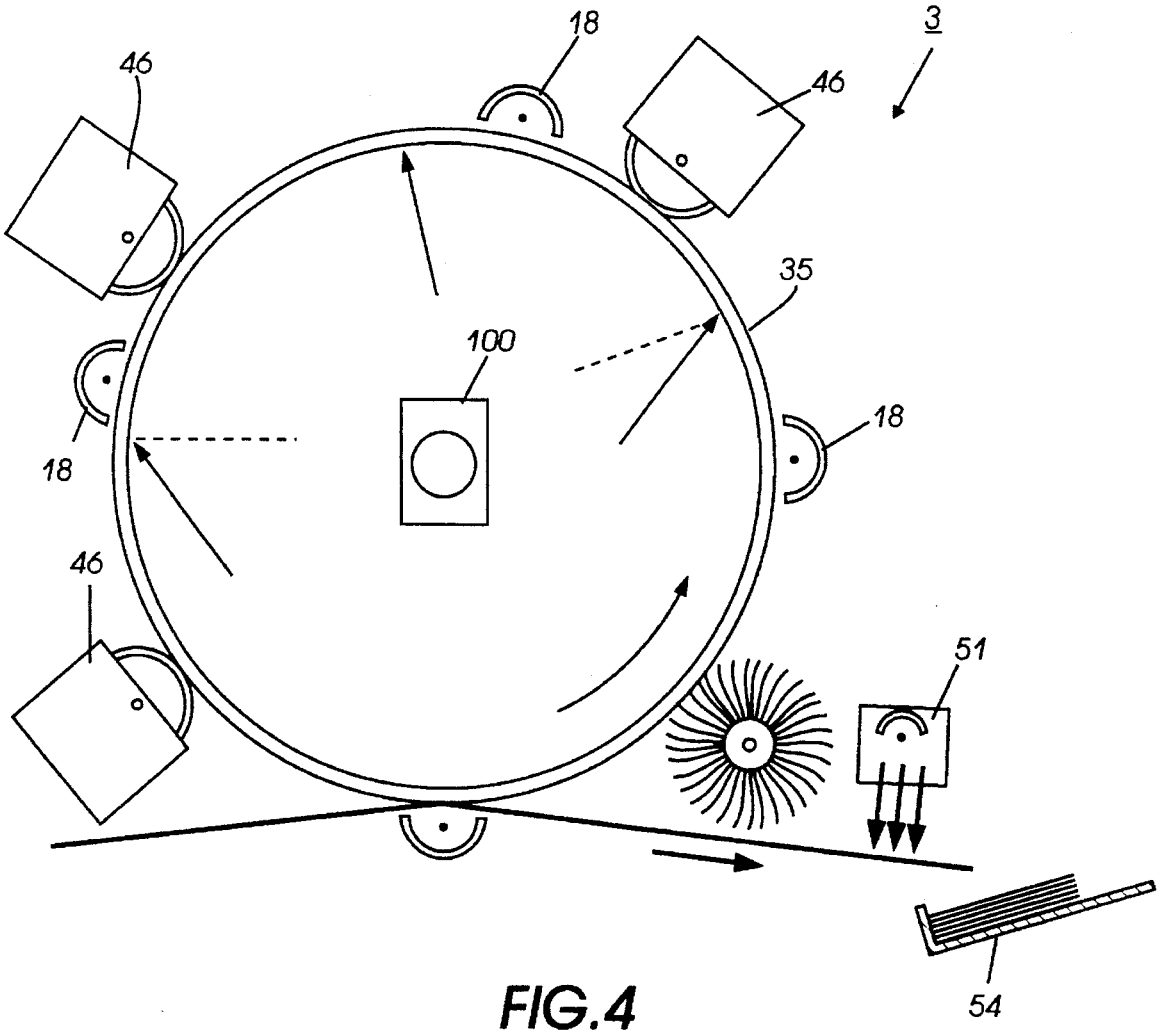
FIG. 4 shows the reprographic printing structure of a color printing unit according to the present invention.
Figure 5:
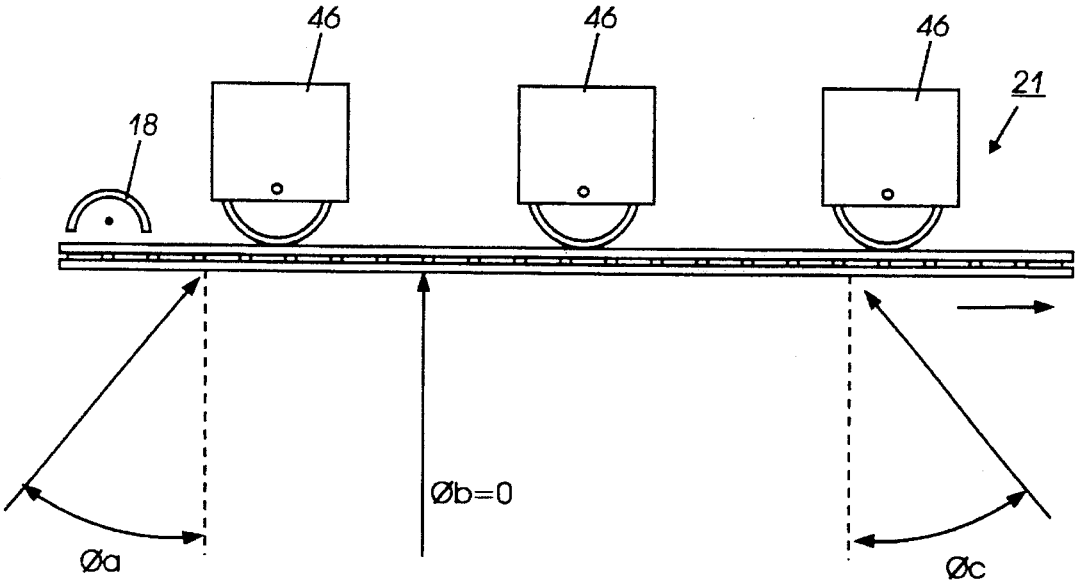
FIG. 5 shows a process schematic of the reprographic printing unit of FIG. 4.

Turning to FIGS. 4 and 5, during printing the latent images on a master are charged and developed as described in the following with, (for example) cyan, magenta, and yellow developer material in the printing unit. Initial uniform charging of the master by unit 18 is followed by discharge of areas to be developed by cyan developer material with an exposure source aligned at angle *Øa*. Following development by cyan developer material, further discharge by exposure at angle *Øb* would define master areas to be developed by magenta developer material. Next the master is discharge by exposure at angle *Øc* would define master areas to be developed by yellow developer material. After discharge exposure and development steps the composite toner cyan, magenta, and yellow developer material image is transferred to paper and fused. Recharge following cyan and magenta development steps has been omitted for simplicity in FIG. 5. Recharge may be helpful, however, depending upon the degree of neutralization achieved by the specific development processes used and the charge retention properties of the master.

The developers of the present embodiment are of the type disclosed in U.S. Pat. Nos. 3,906,897, 3,940,272, and 4,403,848 which are hereby expressly incorporated herein by reference as part of the present disclosure. However, those skilled in the art will recognize that this embodiment of the present invention may be practiced with any developer. Developer units 46 apply toner particles of a specific color which corresponds to the latent image recorded on the master.

It should be noted that an important issue with the present invention is color mixing. Since each toner color will be developed, on demand, at separate geometrically defined locations on the master surface, it seems likely that lateral mixing of these toners, or toner colors, must occur to evoke subtractive color mixing with process color toner materials. Two mechanisms can be identified as candidates to achieve this desired lateral mixing effect. Physical mixing of liquefied toners during the fusing step is one mechanism. Dye diffusion with toner materials as described in D/91094 U.S. Pat. No. 5,366,836, "Sublimable Dye Toner, Method of Manufacture and Method of Use" which, represents a second approach. Excessive lateral mixing, for example, would be expected to degrade fine line reproduction.

Figure 6:
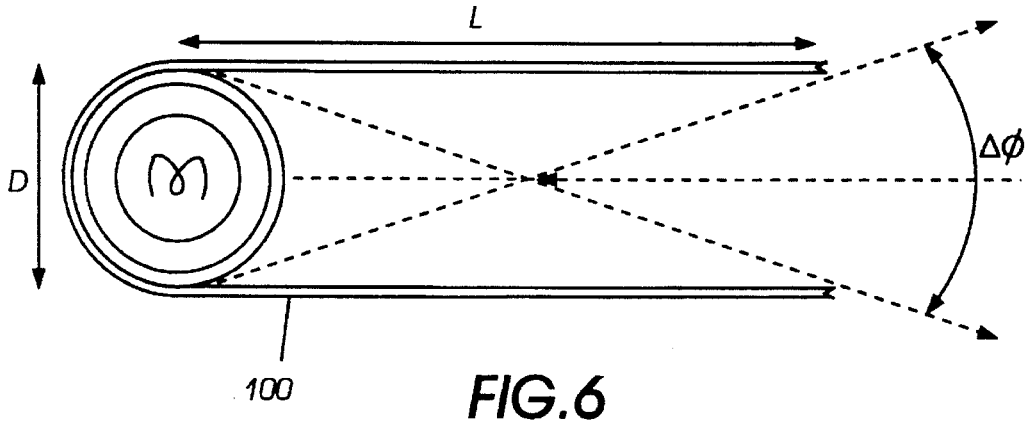
FIG. 6 shows a discharge exposure illumination source of a printing apparatus according to the present invention.

The discharge exposure illumination sources for the DAD'n Xeroprinting process is desired to be uniform in both intensity and alignment to assure proper colors. One design approach, for example, is shown in FIG. 6. In this design, an incandescent line source 100 orthogonal to the Xeroprinting process direction is mounted within a blackened channel to constrain the angular dispersion of illumination to $\Delta Ø$ wherein $\sin(Ø/2)=D/L$. Uniformity of illumination intensity could be controlled by lamp design and/or the addition of a neutral density filter.

After the latent images are developed in superimposed registration with one another to form a multicolored image on the master. These developed images are transferred to copy sheets to form a multicolored image on the copy sheets. This multi-colored image is then fused to the copy sheet, by a known fusing apparatus 51, forming a finished color copy. The printed sheet is then conveyed to and deposited in the sheet delivery 54.

When a print run has been completed, the masters are fed into the sheet path and are deposited in delivery 54 for subsequent removal by a user. These masters may be reused to print additional runs of the same image by simply placing the master into the stand-by tray 31 and, subsequently, transmitting them to the printing unit.

Figure 5A:
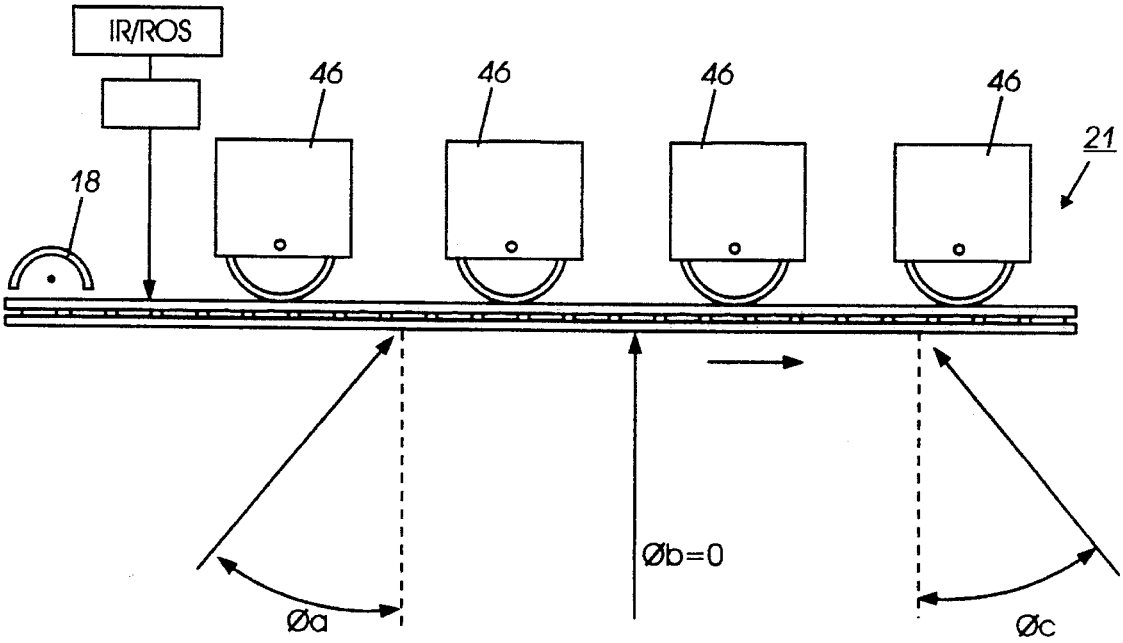
FIG. 5A shows a process schematic of reprographic printing structure of a color printing unit in which varible information can be added to the copy.

Referring to FIG. 5A, it should also be noted that for applications requiring custom annotation of documents there are hybrid system possibilities. For example, custom mailing address information, could be inputted by adding a photoconductive layer to the master and employing a charging device, an infrared ROS and another developer unit can provide a composite developed latent electrostatic image including both fixed and variable infomation content.

While the invention has been described with reference to specific embodiments, it will be apparent to those skilled in the art that many alternatives, modifications, and variations may be made. Accordingly, it is intended to embrace all such alternatives, modifications, and variations that may fall within the appended claims.

I claim:

1. An apparatus for producing a color image on a sheet member comprising:

an electrographic master representative of at least two color components of the color image; and a transfer system for transferring at least two color components of the color image from the electrographic master to a sheet member.

2. The apparatus according to claim 1, wherein said transfer system comprises a development system for sequentially developing said at least two color components of the color image in a predetermined alignment on the electrographic master.

3. The apparatus according to claim 1, further comprising: an electrographic master generator for generating said electrographic master.

4. The apparatus according to claim 3, wherein said electrographic master generator comprises:

a charger for charging the electrographic master;

an exposure system for exposing the electrographic master to at least two predetermined angles of image data representative of said at least two color components of the color image; and a fixing station for fixing said at least two color components of the color image in the electrographic master.

5. The apparatus according to claim 4, wherein said development system comprises:

a charger for charging the electrographic master;

exposure system for exposing the electrographic master to said at least two predetermined angles;

a marking system for marking the electrographic master with first color marking material and second color marking material.

6. The apparatus according to claim 1, further comprising: an annotation system for adding varible infomation to said color image.

7. The apparatus according to claim 6, wherein said annotation system comprises an infrared exposure system for exposing the electrographic master to variable image data.

8. A method for producing a color image on a sheet member comprising the steps of:

producing a electrographic master representative of at least two color components of the color image; and transferring at least two color components of the color image from the electrographic master to a sheet member.

9. A method according to claim 8, further comprising the step of:

sequentially developing said at least two color components of the color image in a predetermined alignment on the electrographic master before said transfer step.

10. A method according to claim 8, wherein said producing step comprises the steps of:

charging the electrographic master;

exposing the electrographic master to at least two predetermined angles to image data representative of the color image to form said compents;

fixing said at least two components of the color image in the electrographic master.

11. A method according to claim 9, wherein said developing step comprises the steps of:

charging the electrographic master;

exposing the electrographic master to a first angle of at least two predetermined angles;

marking the electrographic master with a first color marking material.

12. A method according to claim 11, wherein said developing step further comprises the steps of:

re-charging the electrographic master with first marking material thereon;

re-exposing the electrographic master to a second angle of at least two predetermined angles; and marking the electrographic master with a second color marking material.

* * * * *